US005909979A

United States Patent [19]

Winzen

[11] Patent Number: 5,909,979

[45] Date of Patent: Jun. 8, 1999

[54] ONE-PIECE MACHINABLE INDEX DIVIDER WITH INTEGRAL POCKET

[75] Inventor: Debra Winzen, Chesterfield, Mo.

[73] Assignee: Calvert Holdings LLC, Baltimore, Md.

[21] Appl. No.: 09/016,285

[22] Filed: Jan. 30, 1998

[51] Int. Cl.[6] ..... B42F 13/00

[52] U.S. Cl. ..... 402/79; 281/38

[58] Field of Search ..... 402/79; 281/38; 283/36–42

[56] References Cited

U.S. PATENT DOCUMENTS

| | | | |
|---|---|---|---|
| 5,056,825 | 10/1991 | Templet . | |
| 5,299,879 | 4/1994 | Burrow . | |
| 5,503,435 | 4/1996 | Kline | 402/79 X |
| 5,597,256 | 1/1997 | Burton et al. . | |
| 5,599,128 | 2/1997 | Steiner . | |
| 5,722,694 | 3/1998 | Baldursson | 402/79 X |
| 5,732,977 | 3/1998 | Kohana | 402/79 X |

*Primary Examiner*—Willmon Fridie, Jr.

[57] ABSTRACT

A machinable index divider having an integral pocket is made from a single piece of paper or other printable, flexible and resilient sheet material. The index divider is included as part of a collated set having between five and twelve index dividers with tabs aligned along one edge; each divider is a one-piece structure including a pocket formed from a bottom flap; the pocket is closed on the sides and bottom and opens upwardly. The pocket opening is disposed approximately mid-way between the panel top edge and bottom edge. Preferably, the panel has two or more perforations aligned in close proximity to the left edge. The right edge has a protruding tab area and a recessed pocket edge area. A tab member bearing preprinted indicia protrudes from the tab area on the panel right edge. A method for making the divider includes a number of steps; first, an unfolded blank is cut using a steel rule die to leave a protruding area along the right side. Next, a bottom flap of the first-cut blank is folded to define the bottom edge of the divider and make a pocket. The pocket portion of the cut, folded blank is folded on opposing sides to make first and second side flaps which are then glued to the back panel. Next, a first side of the folded, glued blank has an indicia printed thereon, proximate to the tab area, after which a tab is cut out along the edge of the back panel having the protruding tab area, above the pocket and around the printed indicia, to define a preprinted tab.

15 Claims, 2 Drawing Sheets

ONE-PIECE MACHINABLE INDEX DIVIDER WITH INTEGRAL POCKET

BACKGROUND OF THE INVENTION

1. Field of the Invention

The present invention relates to index dividers for insertion and use in notebooks, binders or the like, and, more particularly, to a set of one-piece index dividers having machinable, pre-printed tabs and an integral pocket for storing loose papers or supplies.

2. Discussion of the Prior Art

Notebooks or binders for retaining sheets of paper typically include a binding having a back panel or spine attached between a front panel and a rear panel. A notebook spine may be openable (e.g., as in loose-leaf binders) or may permanently retain the sheets (e.g., as in spiral bound notebooks). A binder may also include a slidable or removable retainer clip for retaining un-perforated sheets by compression force.

The principal operating structure of a loose-leaf binder is a set of a selectively closable and openable rings, rods or tabs, all generally characterizable as sheet retainers. The most common configuration for loose-leaf binders includes sheet retainers formed as split rings that are selectively openable by spreading one or more tabs or rods included in a driving mechanism for spreading the split rings into an open configuration, thereby permitting individual sheets of loose-leaf paper to be inserted into the binder. The sheet retainers (e.g., split rings) are typically distributed along the length of the binder spine but may be secured to the back panel, and so a wide variety of sheet retainer types and locations have been developed for use in loose-leaf binders. In a three-ring binder, each split ring member penetrates one of several perforations formed in each loose-leaf sheet (e.g, of paper) inserted into the binder. Binders can have one, two, three, five, six, seven and sometimes dozens of sheet retainers, and sheet retainers can have can have various shapes. Because of the multiplicity of sheet retainer configurations, and the standardization of sizes and placement of sheet retainers, binders are sometimes referred to by the capacity (measured in thickness of leaves) and the standard number or configuration of retainers. For example, one may speak of "three-ring" binders, "three-inch three-ring" binders, "two-post lay-flat" binders, or "two-inch three-ring D-ring" binders, and so forth. Split rings may be substantially circular, D-shaped or shaped as a "slant D". The paper industry serves the market by producing leaves of paper for each size and configuration of binders. The dimensions of leaves, and thus of binders, may vary widely in a broad range of standard sizes. For example, binders for holding 8½×11 inch paper or 5½×8½ inch paper are often described by paper size.

It is customary to provide dividers for use in binders where the dividers must also conform to the industry standards for paper size and the number and placement of retainers. For the purposes of exposition in the present application, a three-ring loose leaf binder for holding 8½×11 inch paper is used as an example, but loose-leaf binders and notebooks with all sheet retainer configurations can have problems similar to those discussed below.

A number of office supply vendors provide packaged sets of divider sheets with tabs having pre-printed index information for use in three-ring loose leaf binders holding 8½×11 inch paper; such preprinted dividers are usually die cut to form an integral tab and are called machinable index dividers. Vendors also provide index dividers with separately applied tabs and having a pocket formed thereon, for convenient storage of loose or irregularly sized sheets of paper (without requiring opening of the sheet retainer rings). The pocket dividers of the prior art have necessarily included tabs with insertable indicia for insertion in transparent plastic index tab members, because, with the manufacturing methods of the prior art, it has been impossible to produce a machinable index divider having a pocket. A die cutting step is required to cut out the tab from the paper blank, and using prior art methods, the die cutting step associated with cutting out and defining the tab would also damage at least one side of the pocket. Insertable indexes, by way of contrast, typically have the plastic indicia holding member aligned and bonded onto a side in a subsequent step, so no die cutting step is required to provide a tab.

A machinable index differs from an insertable index in that a machinable index has alphabetical or numerical indicia preprinted on the index tab. The insertable index requires insertion of the indicia, as noted above, and indicia placards are often difficult to write on and insert and require folding. Additionally, the indicia placards can be misplaced and tend to fall out if the openings in the plastic tab members are not stapled or sealed. A machinable index, being preprinted, has the added benefit of permitting a user to easily make several copies of an indexed table of contents for use in notebooks along with the index dividers. When making several notebooks with the insertable index, by way of contrast, each notebook has to have a separate set of index tab indicia prepared and inserted. Insertable indexes must be large enough to provide sufficient room for a user to print a meaningful amount of information on the inserted indicia, and so sets of insertable index dividers tend to be limited to five or eight tabs since ten and twelve count insertable tab sets are considered too small to be functional and therefore have not found acceptance in the marketplace.

Machinable indexes are widely considered to be suitable for applications requiring a more professional appearance and for those situations requiring eight, ten, twelve or larger numbers of arrayed tabs. Accordingly, there has been an unmet need for a machinable index divider including a pocket to provide the general advantages of a machinable index, namely, the ability for a user to create multiple sets of indexes with duplicate title information in a minimal amount of time, using general office printing/duplication machines, and the more professional appearance, as noted above. A machinable index including a pocket would also provide the user with a pocket for storage of loose, unpunched or small materials that may otherwise be difficult to store and organize in a binder.

OBJECTS AND SUMMARY OF THE INVENTION

A primary object of the present invention is to overcome the disadvantages associated with the prior art, as discussed above.

Another object of the present invention is to provide a machinable index divider having an integral pocket.

Yet another object of the present invention is to provide a method for making a machinable index divider with integral pocket providing simple and economical assembly.

Yet another object of the present invention is to provide a one-piece machinable index divider with an integral pocket which can be manufactured using industry-standard die cutting, folding and gluing machinery.

The aforesaid objects are achieved individually and in combination, and it is not intended that the present invention be construed as requiring two or more of the objects to be combined unless expressly required by the claims attached hereto.

In accordance with the present invention, a machinable index divider having an integral pocket is made from a single piece of paper or other printable flexible and resilient sheet material. The index divider of the present invention is included as part of a packaged set having between five and twelve index dividers with tabs aligned along one margin. Each divider is a one-piece structure including a flexible panel with a top edge opposing a bottom edge and a left edge opposing a right edge. A pocket is formed from a bottom flap, is closed on left and right sides and on the bottom edge and opens on a top side. The pocket opening is disposed approximately mid-way between the panel top edge and bottom edge. Preferably, the panel has two or more perforations (or other retainer engaging structural features) aligned in close proximity to the left edge. The right edge comprises a tab area and a pocket area and the tab area protrudes outwardly beyond the extent of the pocket area by a selected distance. A tab member bearing preprinted indicia protrudes from the tab area on the panel right edge. In the preferred embodiment, the tab member carries a Mylar™ brand plastic film reinforcement.

A method in accordance with the present invention includes a number of steps; first, an unfolded blank is cut using a steel rule die to make a first-cut blank including a protruding area along one side. A bottom flap of the first-cut blank is folded to define the bottom edge of the divider and make a pocket using a Bobst™ brand automatic folder, to make a cut, folded blank. The pocket portion of the cut, folded blank is folded on opposing sides to make first and second side flaps which are then glued to the back panel portion of the cut, folded blank, to make a folded, glued blank with a pocket. Next, a first side of the folded, glued blank has an indicia printed thereon, proximate to the tab area, a second side of the folded, glued blank also has an indicia (preferably the same indicia, e.g., "1", "A", a region of color, or the like) printed thereon, proximate the tab area. After printing, a Mylar™ brand plastic film reinforcement is bonded onto the folded, glued blank to cover the printed indicia, proximate to the tab area. A tab is cut out along the edge of the back panel having the protruding tab area, above the pocket and around the printed indicia, to define a preprinted tab projecting from the protruding tab area, above the pocket, at the panel edge. The pocket is preferably sculpted to be recessed or rebated in height at the tab edge, thereby permitting the protruding tab area to have a large height and accommodating larger tab size for a larger number of tab locations; a sculpted, rebated pocket profile permits indexing systems with larger numbers of tabs to be collated together (e.g., twelve divider sets are possible, more if color coding is used instead of numeral or alphabetical indicia). Preferably, but not necessarily, two or more perforations are formed in the panel and are aligned along the retainer edge, opposite the tab edge.

A collection of numbered pocket dividers is collated (e.g., with tabs numbered 1–8), an index sheet (e.g., also bearing numbers 1–8 and space for typing titles corresponding to the indices) and a fly sheet are added, and the assembled elements are then packed in a clear plastic bag for heat sealing, to produce a merchantable set of one-piece, machinable index dividers with integral pockets.

The tab members can be made with or without the plastic reinforcement and sets can be collated together with five, eight, ten, twelve or more collated index dividers.

The above and still further objects, features and advantages of the present invention will become apparent upon consideration of the following detailed description of a specific embodiment thereof, particularly when taken in conjunction with the accompanying drawings wherein like reference numerals in the various figures are utilized to designate like components.

DESCRIPTION OF THE PREFERRED EMBODIMENT

Figure 5:
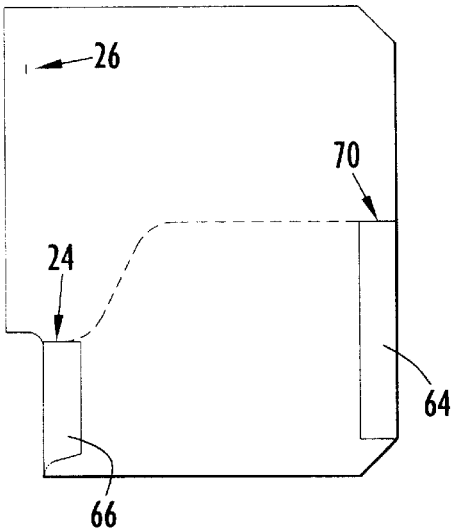
FIG. 5 is a plan view of the second of side a cut, folded, glued blank with a pocket, with printed indicia (i.e., the numeral "1").
Figure 6:
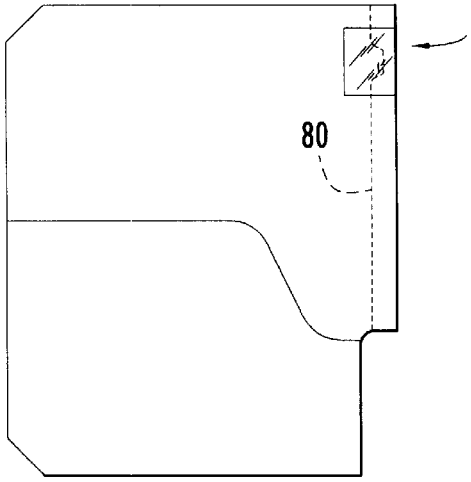
FIG. 6 is a plan view of the first side of a cut, folded, glued blank with a pocket, with printed indicia covered by a reinforcing plastic film, and marked in dotted lines is a region selected for a subsequent die cutting step.
Figure 7:
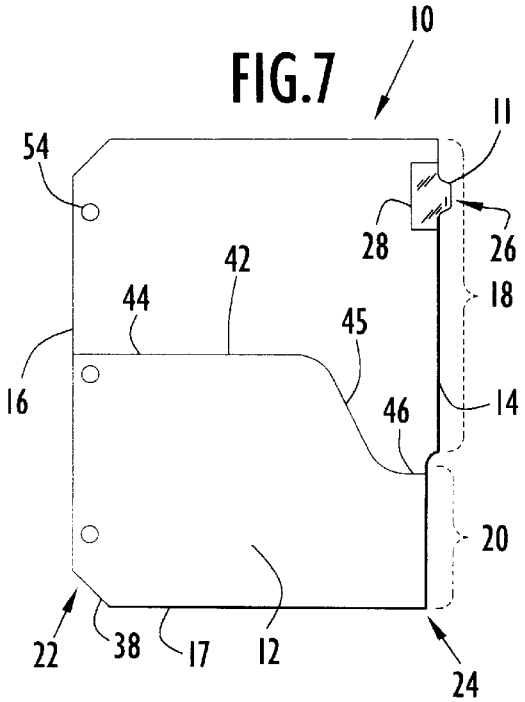
FIG. 7 is a plan view of a one-piece, machinable index divider with an integral pocket.

Referring now to FIGS. 1–8, the sequence of the drawings illustrates the results of method steps used in making a one-piece, machinable index divider with an integral pocket 10; the completed divider being shown in FIG. 7. Referring now to FIG. 7, an exemplary machinable index divider sheet or panel 10, in accordance with the present invention, includes an integral tab 11 and an integral pocket 12 as part of a one-piece structure. The machinable index sheet or panel 10 is of a standard typing sheet size such as 8½ inches by 11 inches and has a tab side or edge 14 opposing a retainer side or edge 16, each of which is substantially perpendicular to a pocket bottom edge 17 defined by a transverse fold line. Tab edge 14 carries an outwardly projecting integral tab 11 in a protruding tab area 18 which is contiguous with and projects laterally beyond the extent of a recessed pocket area 20, along tab edge 14. For purposes of nomenclature, features proximate tab edge 14 will be characterized using the adjective tab-side and features proximate retainer edge 16 will be characterized using the adjective retainer-side.

The flap defining integral pocket 12 is connected to the panel 10 at a first, retainer-side, pocket connection 22 and at an opposing, tab-side, pocket connection 24. Pocket 12 is preferably sculpted to be rebated in height at pocket connection 24 on the tab side 14, thereby permitting the protruding tab area 18 to have a large height and accommodating larger tab size for a larger number of tab locations, since a tab can be located at any height along the protruding tab area 18 of tab edge 14. The upper edge 42 of pocket 12 includes a straight, transverse, raised pocket edge segment 44 extending from the panel retainer edge 16 to a curved pocket edge segment 45 contiguously connecting the rebated pocket edge segment 46 thereto. A sculpted, rebated pocket profile permits indexing systems (e.g., 30, shown in FIG. 8) with larger numbers of tabs (e.g., like tab 11) to be collated together (twelve divider sets are possible, more if color coding is used instead of numeral or alphabetical indicia). Tab 11 preferably includes a printed indicia 26 (e.g., "1") thereon, and preferably carries a plastic film reinforcement 28 preferably color coded in one of a selected number of bright colors such as red, orange, pumpkin, yellow, green, light blue, dark blue or violet, for example.

The index dividers may optionally include perforations for binder rings, or the like. Alternatively, index dividers without perforations may be manufactured for use in report covers with binding clamps or for use with plastic spine comb binding equipment.

In the preferred embodiment, one or more perforations 54 are aligned along retainer edge 16 and spaced therefrom at a selected distance. For example, in the exemplary embodiment shown in FIG. 7, three perforations 54 are included for use in a three-ring binder; perforations 54 are substantially circular, have a diameter of approximately eight millimeters (mm), and the center of each perforation 54 is spaced from retainer edge 16 by a selected distance of approximately nine mm, a spacing which can be varied, depending on the application.

Figure 8:
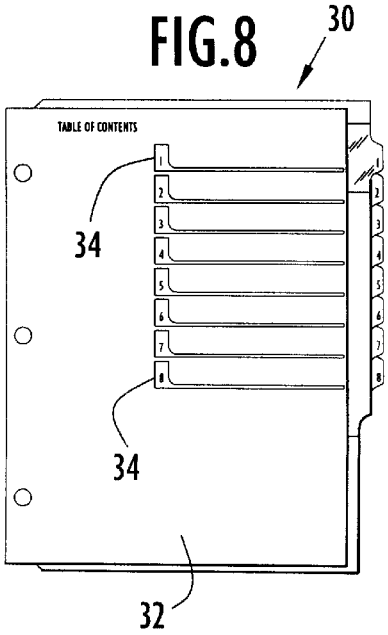
FIG. 8 illustrates, in plan view, of a set of eight collated one-piece, machinable index dividers with integral pockets, assembled with an index cover sheet.

As shown in FIG. 8, the machinable index divider with integral pocket 10 of the present invention can be part of an multi-divider indexing system 30 intended for use in a binder (such as a three-ring binder) and including a plurality of index divider sheets or panels (i.e., similar to the one shown in FIG. 7) for separating the binder contents into sections having appropriate headings. The headings can be printed by the end user using a photocopier, laser printer or the like onto a table of contents sheet (or index sheet) 32 having color coded indicia 34 corresponding in color to the tab color and to the printed indicia (e.g., indicia 26 on tab 11). The collated index dividers have an array of tabs (e.g., 1–8, as shown in FIG. 8) each being offset in the vertical dimension to be visible when stacked together, as shown in FIG. 8. Each divider in the indexing system 30 of FIG. 8 includes a single integral tab projecting outwardly from a protruding tab area 18, thus, while the position of the tab varies from divider to divider in a system (or set), all of the dividers preferably have the same configuration for the sculpted, rebated pocket 12 and protruding tab area 18.

In more general terms, the machinable index divider of the present invention includes a one-piece panel 10 having an integral pocket 12 with a transverse fold line defining a bottom edge 17 of the integral pocket. The integral pocket includes at least one side connection (e.g., 24) preferably on the tab-side of panel 10. The one-piece panel has a retainer side contiguous with and disposed substantially transversely to the pocket bottom edge. The flap defining the integral pocket 12 is attached at the pocket side connection 24 only within the recessed pocket area 20 (thus, tab-side pocket connection 24 does not contact any part of the protruding tab area 18, an important consideration, as explained in greater detail below). Preferably, retainer edge 16 and pocket bottom edge 17 are contiguously joined in a truncated corner 38. In the embodiment illustrated in FIG. 7, retainer edge 16 is also contiguous with a top edge at an upper truncated corner.

Figure 1:
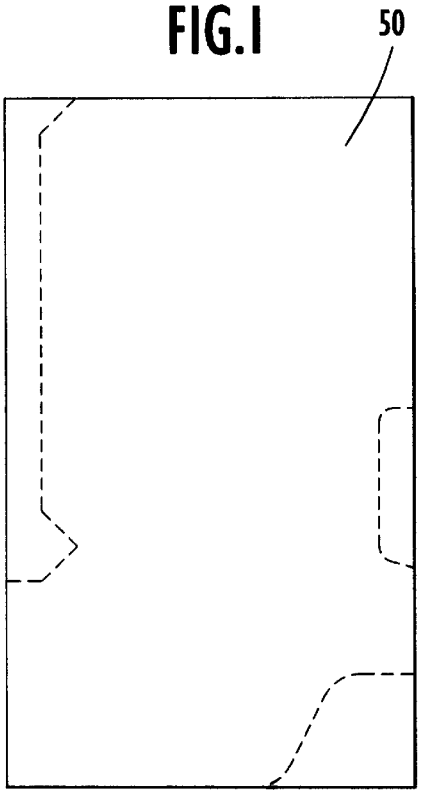
FIG. 1 is a plan view of an uncut, unfolded segment or blank of paper marked in dotted lines for a subsequent cutting step.
Figure 2:
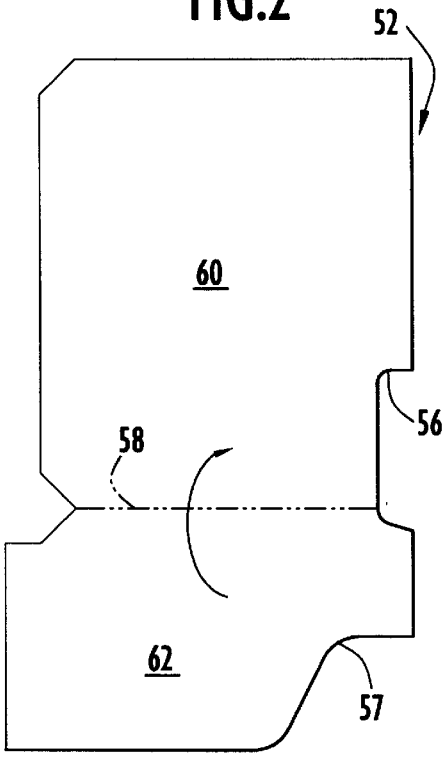
FIG. 2 is a plan view of a cut, unfolded blank illustrating the fold line and direction of the first fold.

Turning now to the method of the present invention, as illustrated in FIG. 1, a one-piece blank 50 is provided and may be cut from a contiguous webbing of paper or another flexible and resilient material adapted to receive printed indicia. One-piece blank 50 is cut, preferably using a steel-rule die to make a first cut blank 52, as shown in FIG. 2. The first cut blank 52 also includes a recess or notch 56 and a rebated corner cut 57; both notch 56 and rebated corner cut 57 are cut into the second edge, opposing the first edge (the second edge is defined above as tab edge 14).

Figure 3:
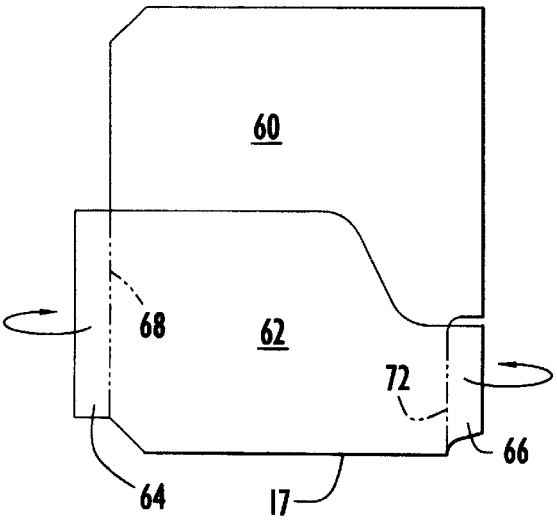
FIG. 3 is a plan view of a cut, folded blank, illustrating the fold lines and direction of the first and second side flap folds.

A transverse fold line 58 is defined in first cut blank 52; transverse fold line 58 intersects recess 56 and defines a pocket flap segment 62. First cut blank 52 is then folded along transverse fold line 58 to define a pocket having a pocket bottom edge 17 (e.g., using a Bobst™ brand automatic folder) to make a cut, folded blank.,as shown in FIG. 3. Pocket flap segment 62 has a retainer-side connection flap 64 opposite a tab-side connection flap 66; as shown in FIG. 3, retainer-side connection flap 64 is defined by a longitudinal retainer-side connection fold line 68 in pocket flap segment 62.

Figure 4:
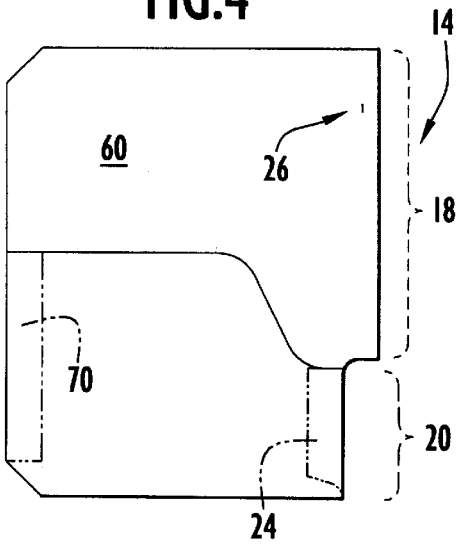
FIG. 4 is a plan view of the first side of a cut, folded, glued blank with a pocket, with printed indicia (i.e., the numeral "1").

In a subsequent step, retainer-side flap 64 is folded over and bonded to panel segment 60 to form a first side connection 70, (e.g., using a Bobst™ brand automatic folder/gluer); simultaneously, tab-side flap 66 is defined by a tab-side longitudinal fold line 72 and tab-side flap 66 is folded over and bonded to panel segment 60 to form a second pocket side connection 74 and make a folded, glued blank with a pocket, as shown in FIG. 4. Second pocket side connection 74 contacts panel segment 60 only in proximity to recess or notch 56, below laterally protruding tab area 18 which is above and contiguous with newly formed recessed pocket area 20. Thus, second side connection 74 lies wholly within recessed pocket area 20 and does not contact any part of protruding tab area 18. The sculpted, rebated pocket shape (shown in FIG. 4) permits the protruding tab area 18 to occupy a longer portion of tab edge 14.

Preferably, indicia 26 (e.g. "1"), are printed, embossed or applied on the panel front (as shown in FIG. 4) and the panel back (as shown in FIG. 5). Indicia 26 are located on the protruding tab area 18 at a transverse spacing disposed beyond the lateral extent of the recessed pocket area 20 (as shown in FIG. 6).

Turning now to FIG. 6, the panel, adjacent tab edge 14, is die cut in the protruding tab area 18, on tab cut line 80 around printed indicia 26, to define an offset integral tab (e.g., 11 in FIG. 8). Tab cut line 80 is substantially longitudinal and the entire tab cut line 80 is offset or spaced laterally beyond the lateral extent of recessed pocket area 20. The offset of the tab cut line 80 permits standard types of folding and cutting equipment to be used in a new method of making a machinable index divider with an integral pocket. The method (and structure) of the present invention prevents destruction of the tab-side pocket connection 74 during the die cutting step used to define the tab (e.g., 11). Preferably, as shown in FIG. 6, a plastic (e.g. Mylar™) reinforcing film segment is placed over the printed indicia 26 and bonded in situ, before the tab cutting step.

Optionally, one or more perforations 54 may be drilled or hole-punched proximate to (and preferably aligned with) retainer edge 16, as shown in FIG. 7.

A collection of numbered pocket dividers are collated and assembled, each divider having a numbered (e.g. 1–8) tab positioned such that, when stacked as shown in FIG. 8, each tab is visible. An index sheet or table of contents sheet 32 can then be added to the collated stack of index dividers along with a fly sheet, and the assembled elements are then ready for packaging in a clear plastic bag, ready for heat sealing or the like, to produce a merchantable set of one-piece, machinable index dividers with integral pockets. The set constitutes an indexing system 30 with a table of contents sheet 32 readily adapted to be completed by the end user with automated equipment such as a photocopying machine, computer printer or the like, for describing the contents of a binder, notebook, folio or report cover.

It will be appreciated that the embodiments described above and illustrated in the drawings represent only a few of the many ways of implementing a one-piece machinable index divider in accordance with the present invention. Accordingly, for purposes of nomenclature, "retainers" means split rings, D rings, square rings, slide locks, rods, tabs, spiral coils, posts, cable or cordage (such as string), plastic spine comb binder fingers, or slidable compression clamps for retaining perforated or un-perforated loose-leaf or captive sheets in a binder, notebook, folio or report cover. Retainers may be, but need not be, selectively openable and closable (e.g., such as split rings). A continuous wire formed into a plurality of coils thus forms a plurality of retainers. Thus, by "retainer receiving element" is meant a perforation, loop, slot or other cooperating structure adapted to receive and be supported by whichever retainer is carried by the binder, notebook, folio or report cover. By "binder" is meant a structure for holding sheets and including one or more retainers, such as loose-leaf binders, post binders, strip binders, plastic spine comb binders, spiral binders, ring binders, split ring binders (with one, two, three, four or more rings), such as photo albums, scrap books, folios, report covers (or presentation binders), slotted lock post ledger binders or data binders. By "tab" is meant an integrally formed projecting feature adapted to be seen and grasped by a user. By "printed indicia" is meant a numeral, alphabetical character, symbol, region of color, visible pattern or texture (e.g., braille) applied to the tab for indicating something to a user about the contents of the binder, notebook or folio, however applied (e.g., through printing, applique, embossing or engraving, etc.)

In as much as the present invention is subject to various modifications and changes in detail, the above description of a preferred embodiment is intended to be exemplary only and not limiting. It is believed that other modifications, variations and changes will be suggested to those skilled in the art in view of the teachings set forth herein. It is therefore to be understood that all such variations, modifications and changes are believed to fall within the scope of the present invention as defined by the appended claims.

What is claimed is:

1. A divider for insertion in a binder having at least one retainer, said divider comprising:

a one-piece panel having an integral pocket with a transverse fold line defining a bottom edge of said integral pocket;

said integral pocket including a first side connection opposing a second side connection;

said one-piece panel having a retainer side contiguous with and disposed substantially transversely to said pocket bottom edge, and a tab side opposing the retainer side with a transversely projecting integral tab;

said panel tab side including a protruding area and a recessed area contiguous with the protruding area, wherein said recessed area is also contiguous with said pocket bottom edge, said protruding area projecting beyond said recessed area;

said pocket being attached to said panel, proximate said retainer side, by said first side connection;

said pocket being attached to said panel, proximate said tab side, by said second side connection.

2. The divider of claim 1, wherein said panel includes at least one perforation, said perforation being proximate said retainer edge.

3. A divider for insertion in a binder having at least one retainer, said divider comprising:

a one-piece panel having an integral pocket with a transverse fold line defining a bottom edge of said integral pocket;

said integral pocket including a side connection;

said one-piece panel having a retainer side contiguous with and disposed substantially transversely to said pocket bottom edge, and a tab side opposing the retainer side with a transversely projecting integral tab;

said panel including at least one retainer receiving element proximate to said panel retainer side;

said panel tab side including a protruding area and a recessed area contiguous with the protruding area, said recessed area is also contiguous with said pocket bottom edge, said protruding area projecting beyond said recessed area;

said pocket being attached to said panel, proximate said tab side recessed area, by said pocket side connection.

4. The divider of claim 3, wherein said retainer receiving element is a perforation through said panel.

5. The divider of claim 3, wherein said integral pocket further includes a second side connection, said second side connection being attached to said panel proximate said retainer side.

6. The divider of claim 3, wherein said pocket top edge includes a raised segment contiguously joined to a rebated segment.

7. The divider of claim 3, further including a plastic film reinforcement carried upon and bonded to said projecting integral tab.

8. The divider of claim 7, wherein said plastic film reinforcement is colored and substantially transparent.

9. A method for making a one-piece machinable index divider with an integral pocket, comprising the steps of:

a) providing a one-piece blank having first and second opposing edges;

b) cutting a recess in one of said opposing edges;

c) folding said blank along a transverse fold line intersecting said recess, to define a pocket flap and a panel having a recess area contiguous with a protruding area;

d) bonding said pocket flap to said panel at said recess area to define an integral pocket; and e) cutting said panel protruding area to define an integral tab.

10. The method of claim 9, further comprising the steps of:

d1) printing tab indicia on the protruding area segment corresponding to the integral tab;

f) providing an index sheet;

g) printing indicia on the index sheet corresponding to the tab indicia.

h) assembling the index sheet and the one-piece machinable index divider with an integral pocket;

i) packaging the assembled index sheet and divider.

11. The method of claim 10, further comprising the step of:

d2) affixing a flexible, resilient transparent reinforcement on the protruding area segment corresponding to the integral tab.

12. A method for making a one-piece machinable index divider with an integral pocket, comprising the steps of:

a) providing a one-piece blank having first and second opposing edges;

b) cutting a recess in one of said opposing edges;

c) folding said blank along a transverse fold line intersecting said recess, to define a pocket flap and a panel having a recess area contiguous with a protruding area;

d) bonding said pocket flap to said panel at said recess area to define an integral pocket;

e) printing indicia on the protruding area;

f) affixing a transparent reinforcement on the protruding area segment bearing the printed indicia.

g) cutting said panel protruding area to define an integral tab.

13. The method of claim 12, wherein said step (g) includes die cutting away a portion of the panel protruding area to leave an integral tab bearing the printed indicia and the transparent reinforcement.

14. The method of claim 13, further comprising the steps of:

h) providing an index sheet;

i) printing colored indicia on the index sheet corresponding to the tab indicia and to the color of the reinforcement.

j) assembling the index sheet and the one-piece machinable index divider with an integral pocket;

k) packaging the assembled index sheet and divider.

15. The method of claim 12, wherein step d) includes the steps of:

d1) longitudinally folding said pocket flap along one side to make a side connecting flap;

d2) bonding said side connecting flap to said panel at said recess area to define an integral pocket.

* * * * *